US006830522B1

(12) United States Patent
Chen

(10) Patent No.: US 6,830,522 B1
(45) Date of Patent: Dec. 14, 2004

(54) VERTICAL AERIAL ASSEMBLY FOR VOLLEYBALL

(76) Inventor: Benjamin Chen, No. 1, Alley 16, Lane 40, Jinn Te Rd., Taichung (TW)

( * ) Notice: Subject to any disclaimer, the term of this patent is extended or adjusted under 35 U.S.C. 154(b) by 0 days.

(21) Appl. No.: 10/389,596

(22) Filed: Mar. 12, 2003

(51) Int. Cl.[7] ..... A63B 71/00
(52) U.S. Cl. ..... 473/494
(58) Field of Search ..... 473/492, 467, 473/473, 494; 248/539

(56) References Cited

U.S. PATENT DOCUMENTS 3,208,702 A * 9/1965 Rowe ..... 248/539
3,860,240 A * 1/1975 Koch ..... 473/467
3,940,139 A * 2/1976 Barnes ..... 473/494
D391,152 S * 2/1998 Lane et al. ..... D8/395
5,954,308 A * 9/1999 Lane et al. ..... 248/539

FOREIGN PATENT DOCUMENTS

FR 2698552 * 6/1994 ..... A63B/61/00

* cited by examiner

*Primary Examiner*—Raleigh W. Chiu

(57) ABSTRACT

A vertical aerial assembly for the volleyball includes a lower fixing rod, a lower screw member, an aerial, a handle, an upper screw member, and an upper fixing rod. The vertical aerial assembly has a simplified construction with fewer parts, thereby decreasing the cost of fabrication. In addition, the vertical aerial assembly is assembled easily and conveniently, thereby saving the time of assembly. Further, the handle only needs to form a through hole to fit the outer diameter of the aerial without having to additionally provide a stepped hole, thereby decreasing the cost of fabrication.

7 Claims, 9 Drawing Sheets

VERTICAL AERIAL ASSEMBLY FOR VOLLEYBALL

BACKGROUND OF THE INVENTION

1. Field of the Invention

The present invention relates to a vertical aerial assembly for a volleyball net assembly, and more particularly to a vertical aerial assembly that has a simplified construction with fewer parts, thereby decreasing the cost of fabrication.

2. Description of the Related Art

A conventional vertical aerial assembly for a volleyball net assembly in accordance with the prior art shown in FIGS. 1–3 comprises a rod 80, a lower nut 81, a lower fixing member 82, a handle 83, an aerial 86, an upper nut 84, an upper fixing member 85, and an urging member 842.

The rod 80 has a first end formed with an enlarged head 801 and a second end formed with an outer thread 802 and a pin hole 803 for insertion of a pin 804. The lower nut 81 is formed with an inner thread 811 screwed on the outer thread 802 of the rod 80. The lower fixing member 82 is mounted on the rod 80 and retained by the pin 804. The lower fixing member 82 is provided with a lower fixing hook 821. The handle 83 is mounted on the rod 80, and has one end formed with a stepped edge 831 for stopping the enlarged head 801 of the rod 80. The aerial 86 has one end secured in the handle 83. The upper nut 84 is secured on the aerial 86, and is formed with an outer thread 841. The upper fixing member 85 is mounted on the aerial 86, and has a first end formed with an inner thread 853 screwed on the outer thread 841 of the upper nut 84, and a second end formed with a slideway 851 and provided with an upper fixing hook 852. The urging member 842 is mounted on the aerial 86, and is slidable on the slideway 851.

In operation, the lower nut 81 is rotated, and the inner thread 811 of the lower nut 81 is screwed on the outer thread 802 of the rod 80, so that the lower nut 81 is moved from the position as shown in FIG. 2 to the position as shown in FIG. 3 where the lower nut 81 is rested on the inner side of the lower fixing hook 821 of the lower fixing member 82. Then, the handle 83 is rotated. At this time, the handle 83 and the upper nut 84 are secured on the aerial 86. Thus, when the handle 83 is rotated, the upper nut 84 is rotated by rotation of the handle 83, and the outer thread 841 of the upper nut 84 is screwed into the inner thread 853 of the upper fixing member 85. At the same time, the urging member 842 is pushed by the upper nut 84 to slide on the slideway 851, so that the urging member 842 is moved from the position as shown in FIG. 2 to the position as shown in FIG. 3 where the urging member 842 is rested on the inner side of the upper fixing hook 852 of the upper fixing member 85.

In assembly, each side of the net (not shown) has a first end clamped between the lower nut 81 and the inner side of the lower fixing hook 821 of the lower fixing member 82, and a second end clamped between the urging member 842 and the inner side of the upper fixing hook 852 of the upper fixing member 85. Thus, the vertical aerial assembly for the volleyball is mounted on each side of the net.

However, the conventional vertical aerial assembly for a volleyball net assembly in accordance with the prior art has the following disadvantages.

1. The handle 83 needs to form a hole to fit the diameter of the aerial 86 and to form a stepped edge 831 to fit the size of the enlarged head 801 of the rod 80, thereby increasing the cost of fabrication.

2. The conventional vertical aerial assembly for a volleyball net assembly has a complicated construction with many parts, thereby increasing the cost of fabrication.

3. The conventional vertical aerial assembly for a volleyball net assembly needs to provide a push member 842 and to provide a slideway 851 on the upper fixing member 85 for receiving the push member 842, thereby increasing the cost of fabrication.

SUMMARY OF THE INVENTION

The present invention has arisen to mitigate and/or obviate the disadvantage of the conventional vertical aerial assembly for a volleyball net assembly.

The primary objective of the present invention is to provide a vertical aerial assembly for a volleyball net assembly, wherein the vertical aerial assembly has a simplified construction with fewer parts, thereby decreasing the cost of fabrication.

Another objective of the present invention is to provide a vertical aerial assembly for a volleyball net assembly, wherein the vertical aerial assembly is assembled easily and conveniently, thereby saving the time of assembly.

A further objective of the present invention is to provide a vertical aerial assembly for a volleyball net assembly, wherein the handle only needs to form a through hole to fit the outer diameter of the aerial without having to additionally provide a stepped hole, thereby decreasing the cost of fabrication.

In accordance with the present invention, there is provided a vertical aerial assembly for a volleyball net assembly, comprising a lower fixing rod, a lower screw member, an aerial, a handle, an upper screw member, and an upper fixing rod, wherein:

- the lower fixing rod has a first end formed with an outer threaded portion and provided with a lower fixing hook;
- the lower screw member is mounted on the lower fixing rod, and has an inner wall formed with an inner threaded portion screwed on the outer threaded portion of the lower fixing rod;
- the aerial has one end secured in the lower fixing rod;
- the handle is secured on the aerial, and has one end rested on a second end of the lower fixing rod;
- the upper screw member is secured on the aerial, and has an inner wall formed with an inner threaded portion; and
- the upper fixing rod is mounted on the aerial, and has a first end formed with an outer threaded portion screwed into the inner threaded portion of the upper screw member, and a second end provided with an upper fixing hook.

Further benefits and advantages of the present invention will become apparent after a careful reading of the detailed description with appropriate reference to the accompanying drawings.

DETAILED DESCRIPTION OF THE INVENTION

Figure 1:
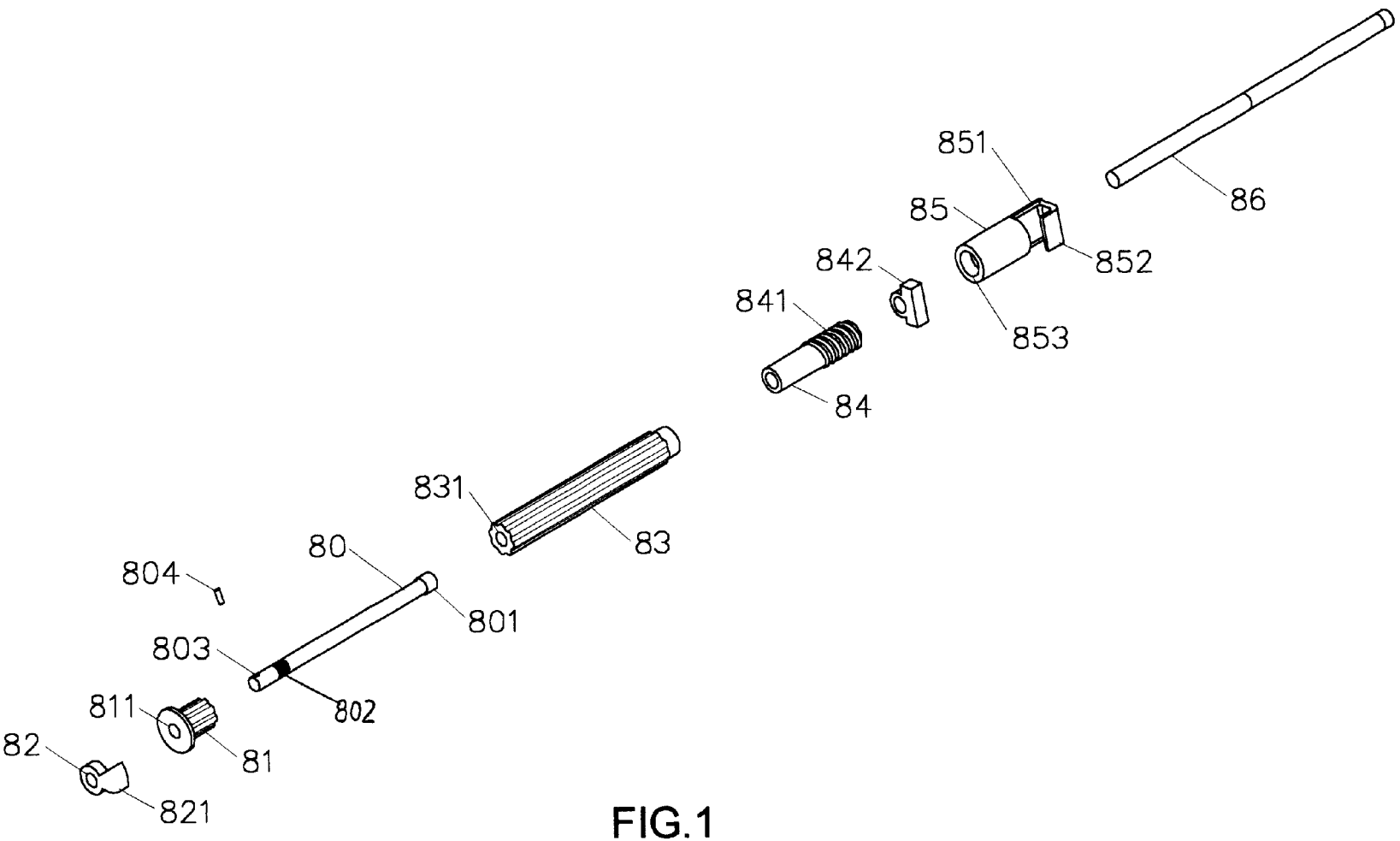
FIG.1 PRIOR ART
FIG. 1 is an exploded perspective view of a conventional vertical aerial assembly for a volleyball net assembly in accordance with the prior art.
Figure 2:
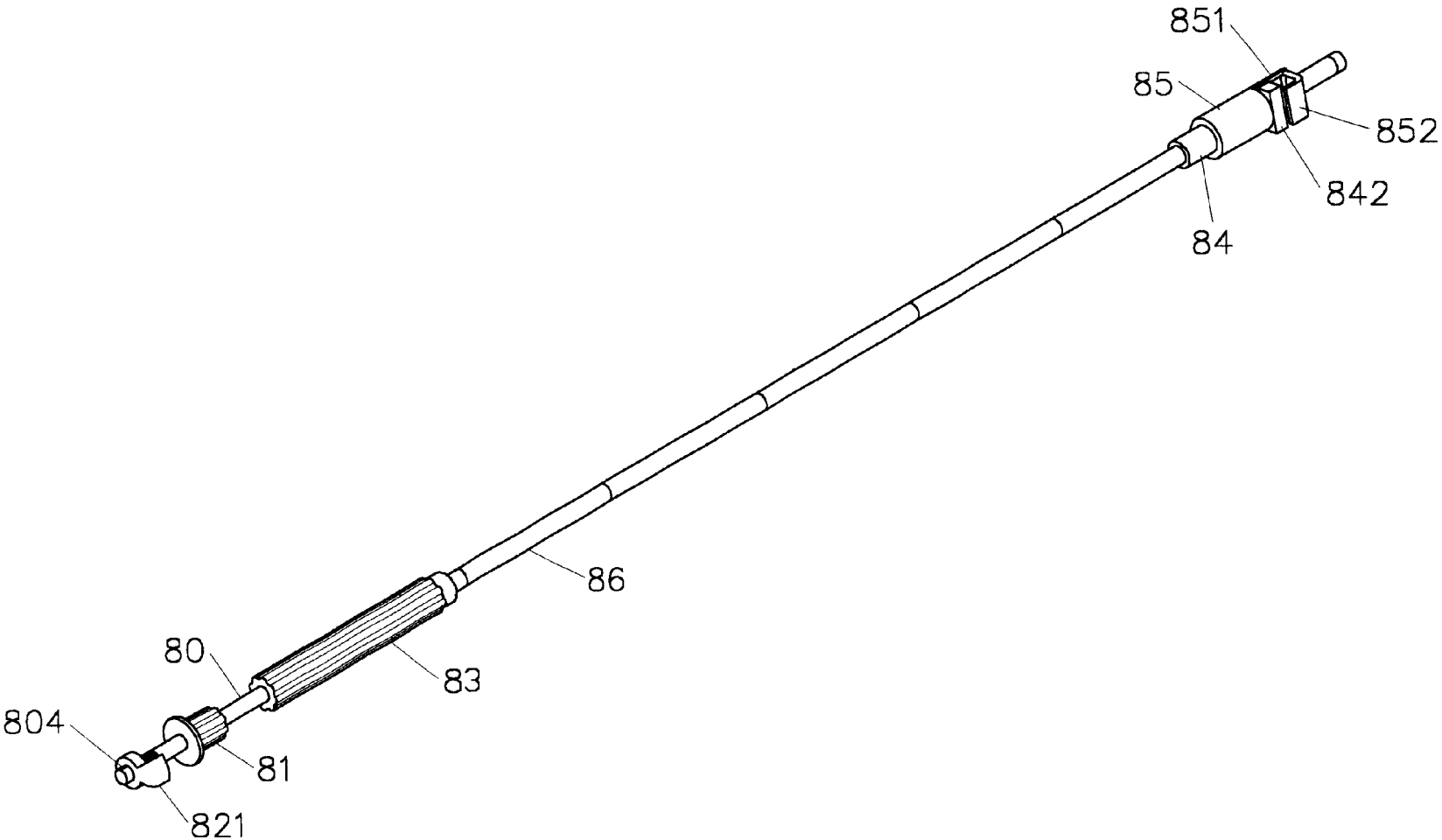
FIG.2 PRIOR ART
FIG. 2 is a perspective assembly view of the conventional vertical aerial assembly for a volleyball net assembly in accordance with the prior art.
Figure 3:
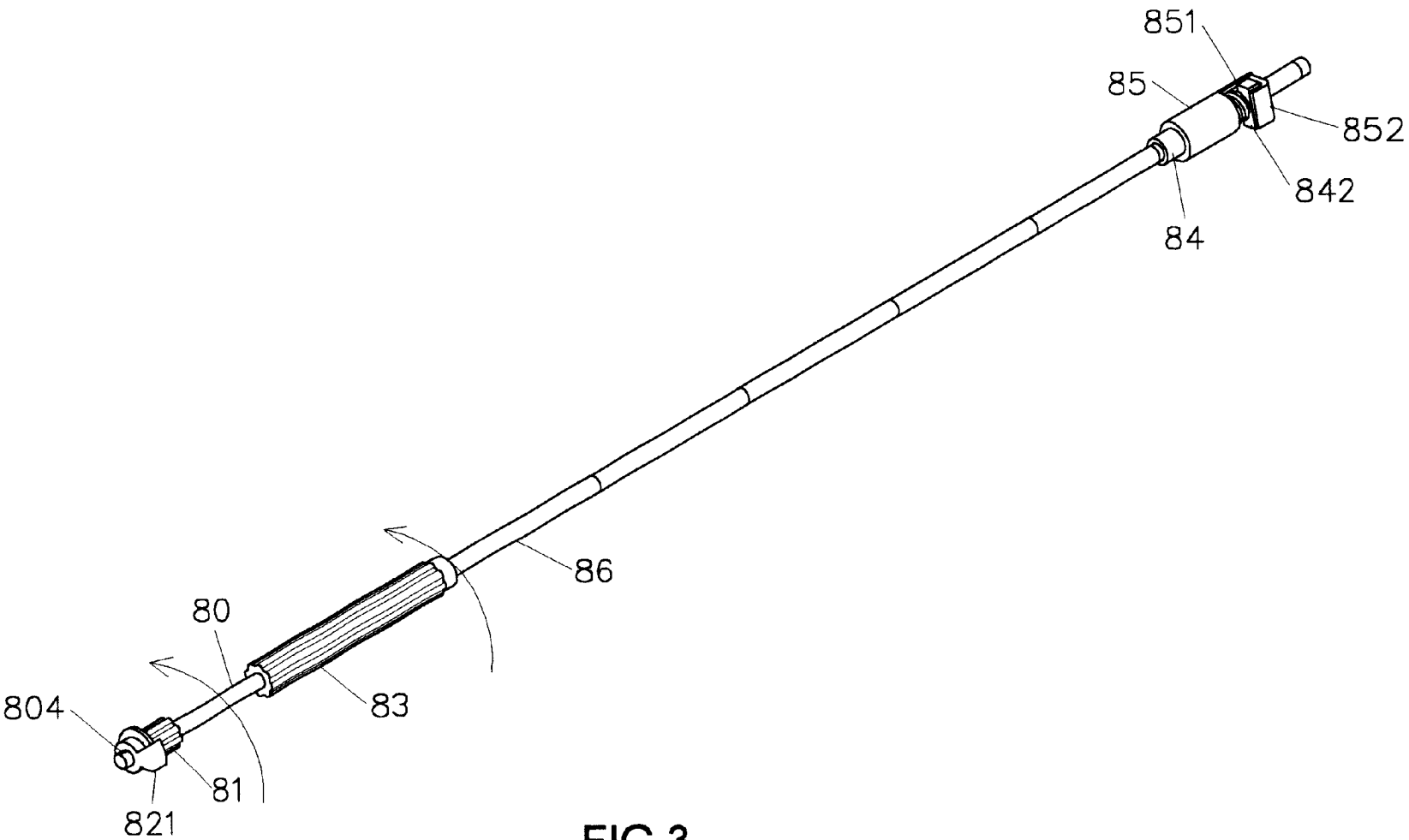
FIG.3 PRIOR ART
FIG. 3 is a schematic operational view of the conventional vertical aerial assembly for a volleyball net assembly as shown in FIG. 2 in use.
Figure 4:
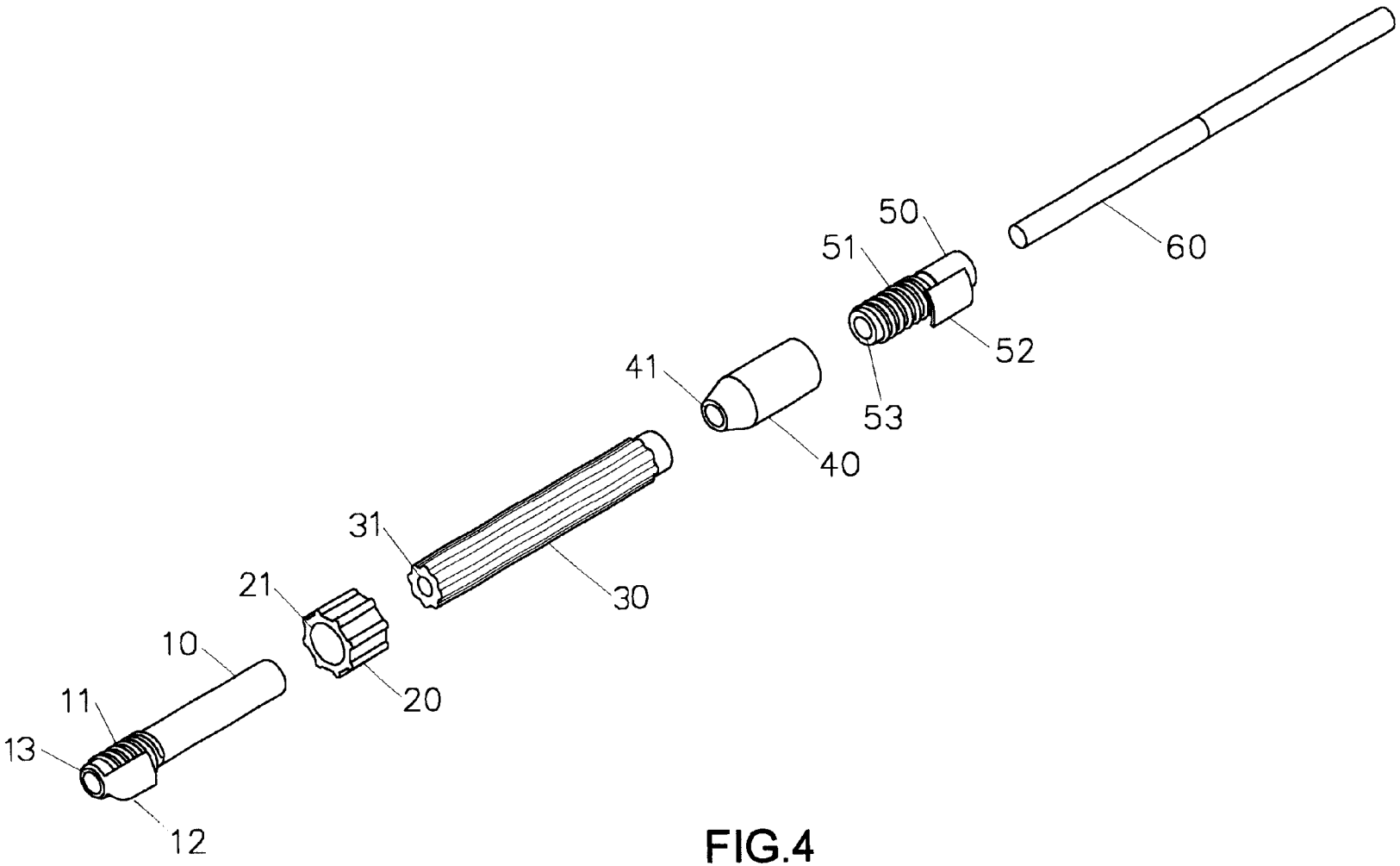
FIG. 4 is an exploded perspective view of a vertical aerial assembly for a volleyball net assembly in accordance with a first embodiment of the present invention.
Figure 5:
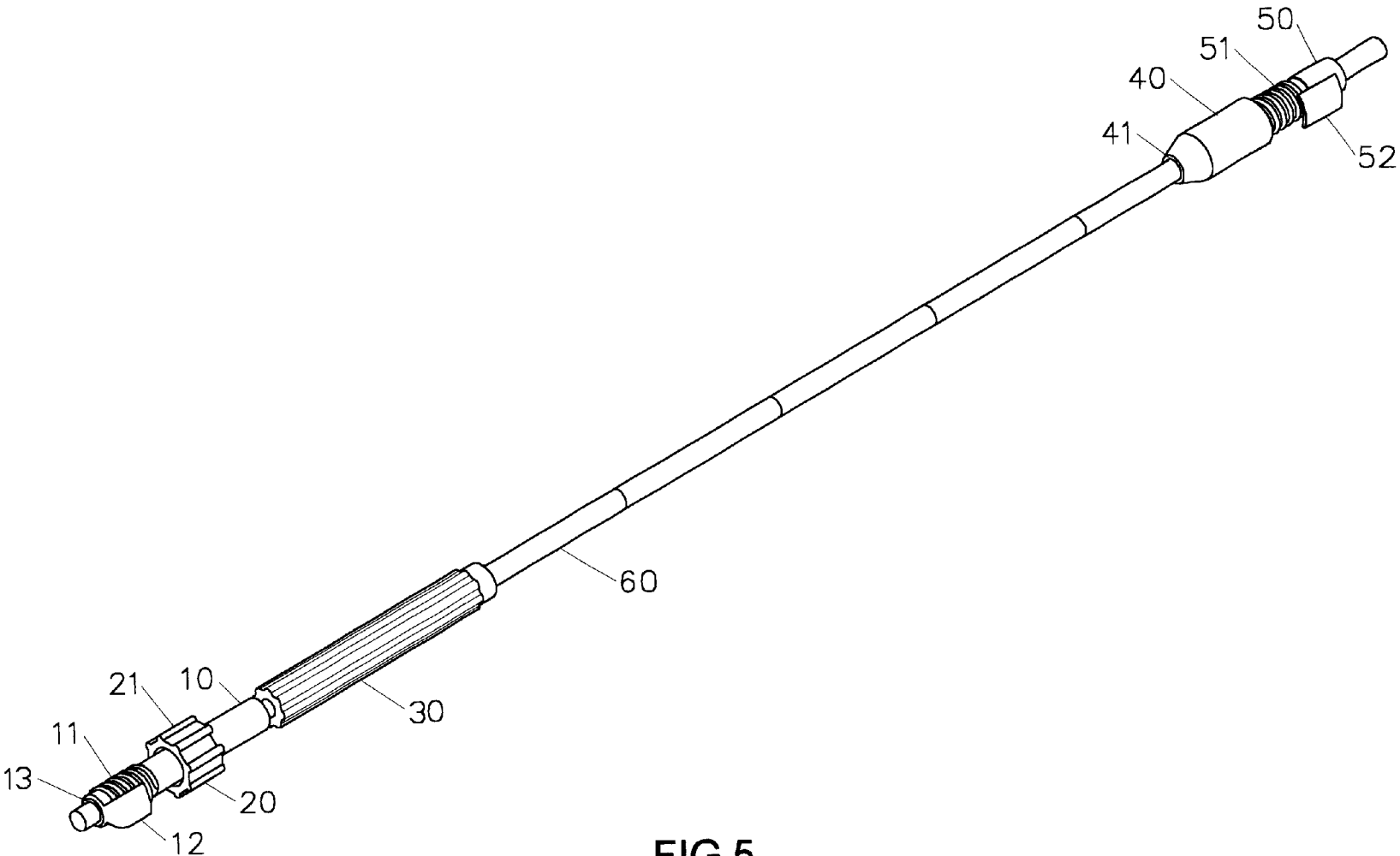
FIG. 5 is a perspective assembly view of the vertical aerial assembly for a volleyball net assembly in accordance with the first embodiment of the present invention.

Referring to the drawings and initially to FIGS. 4 and 5, a vertical aerial assembly for a volleyball net assembly in accordance with a first embodiment of the present invention comprises a lower fixing rod 10, a lower screw member 20, an aerial 60, a handle 30, an upper screw member 40, and an upper fixing rod 50.

The lower fixing rod 10 has an inner wall formed with a through hole 13. The lower fixing rod 10 has a first end formed with an outer threaded portion 11 and provided with a lower fixing hook 12.

The lower screw member 20 is mounted on the lower fixing rod 10, and has an inner wall formed with an inner threaded portion 21 screwed on the outer threaded portion 11 of the lower fixing rod 10.

The aerial 60 is an elongated rod, and has one end secured in the through hole 13 of the lower fixing rod 10.

The handle 30 is secured on the aerial 60, and has one end rested on a second end of the lower fixing rod 10. The handle 30 has an inner wall formed with a through hole 31 for passage of the aerial 60.

The upper screw member 40 is secured on the aerial 60, and has an inner wall formed with an inner threaded portion 41.

The upper fixing rod 50 is mounted on the aerial 60, and has an inner wall formed with a through hole 53 for passage of the aerial 60. The lower fixing rod 10 has a first end formed with an outer threaded portion 51 screwed into the inner threaded portion 41 of the upper screw member 40, and a second end provided with an upper fixing hook 52.

In assembly, the lower screw member 20 is mounted on the lower fixing rod 10. Then, the aerial 60 is secured in the through hole 13 of the lower fixing rod 10. Then, the handle 30 is secured on the aerial 60, with its one end rested on the second end of the lower fixing rod 10. Then, the upper screw member 40 is secured on the aerial 60. Then, the upper fixing rod 50 is mounted on the aerial 60, thereby assembling the vertical aerial assembly for a volleyball net assembly in accordance with the first embodiment of the present invention.

Figure 6:
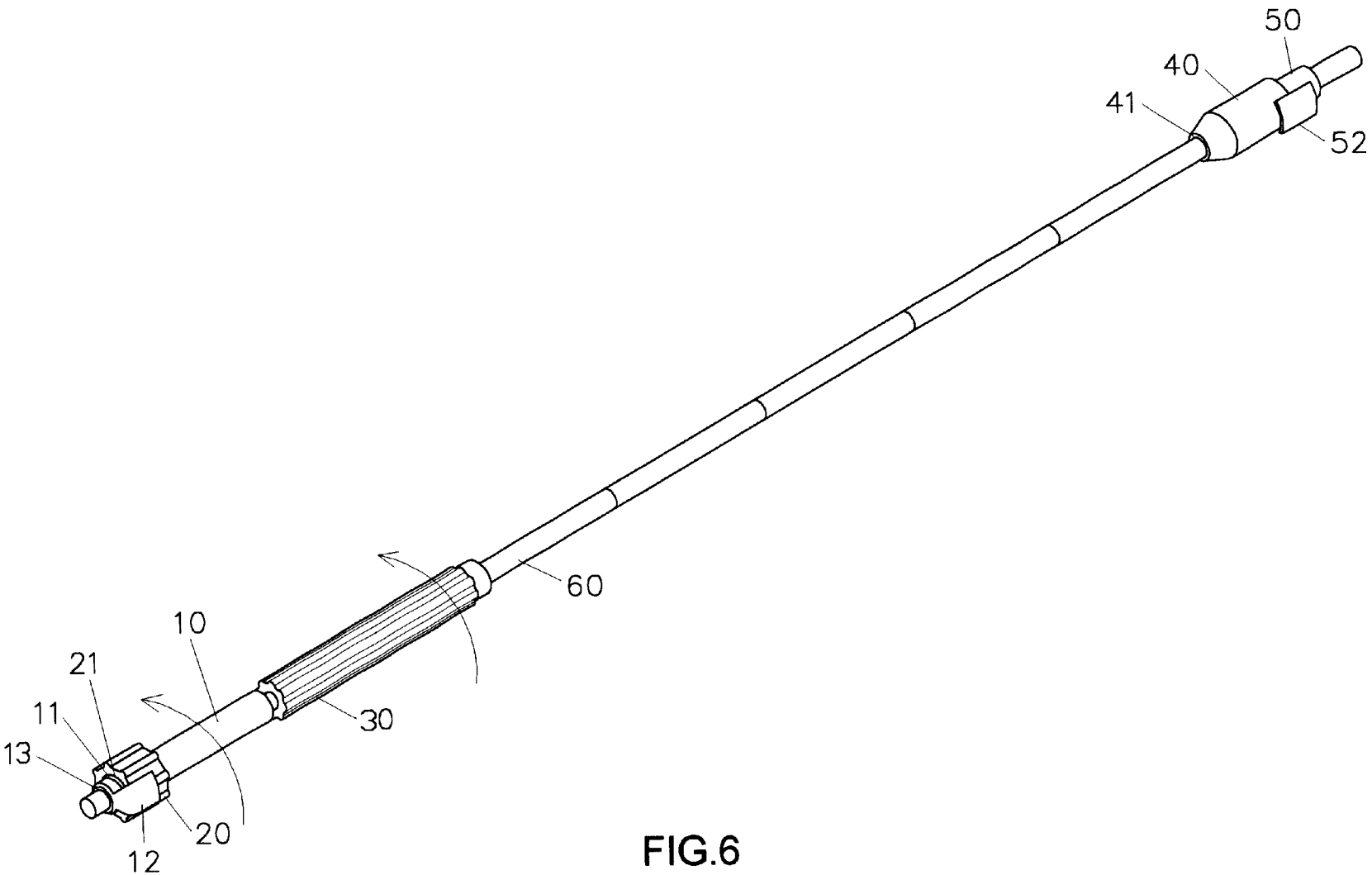
FIG. 6 is a schematic operational view of the vertical aerial assembly for a volleyball net assembly as shown in FIG. 5 in use.

In operation, referring to FIG. 6 with reference to FIGS. 4 and 5, the lower screw member 20 is rotated on the lower fixing rod 10, and the inner threaded portion 21 of the lower screw member 20 is screwed on the outer threaded portion 11 of the lower fixing rod 10, so that the lower screw member 20 is rotated on the lower fixing rod 10 to move from the position as shown in FIG. 5 to the position as shown in FIG. 6 where the lower screw member 20 is rested on the inner side of the lower fixing hook 12 of the lower fixing rod 10. Then, the handle 30 is rotated. At this time, the handle 30 and the upper screw member 40 are secured on the aerial 60. Thus, when the handle 30 is rotated, the upper screw member 40 is rotated by rotation of the handle 30, and the inner threaded portion 41 of the upper screw member 40 is screwed on the outer threaded portion 51 of the upper fixing rod 50, so that the upper screw member 40 is moved toward the upper fixing rod 50, and is moved from the position as shown in FIG. 5 to the position as shown in FIG. 6 where the upper screw member 40 is rested on the inner side of the upper fixing hook 52 of the upper fixing rod 50.

Figure 7:
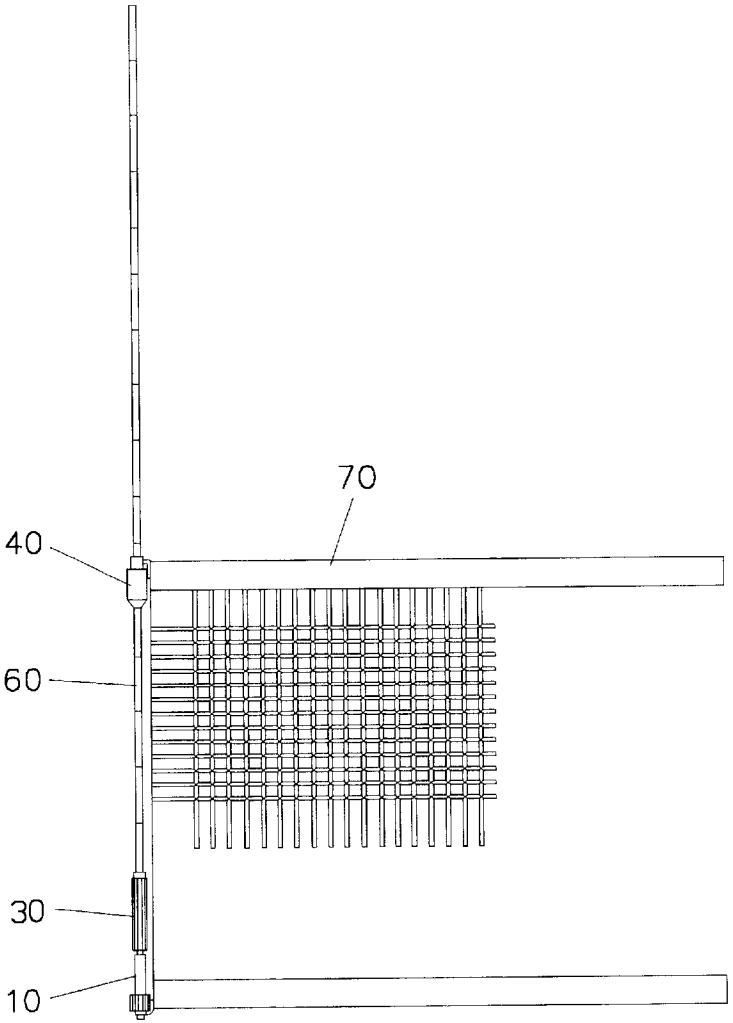
FIG. 7 is a schematic plan view showing the vertical aerial assembly for a volleyball net assembly being mounted on the net.

Referring to FIG. 7, each side of the net 70 has a first end clamped between the lower screw member 20 and the lower fixing hook 12 of the lower fixing rod 10, and a second end clamped between the upper screw member 40 is rested on the inner side of the upper fixing hook 52 of the upper fixing rod 50. Thus, the vertical aerial assembly for a volleyball net assembly is mounted on each side of the net 70.

Figure 8:
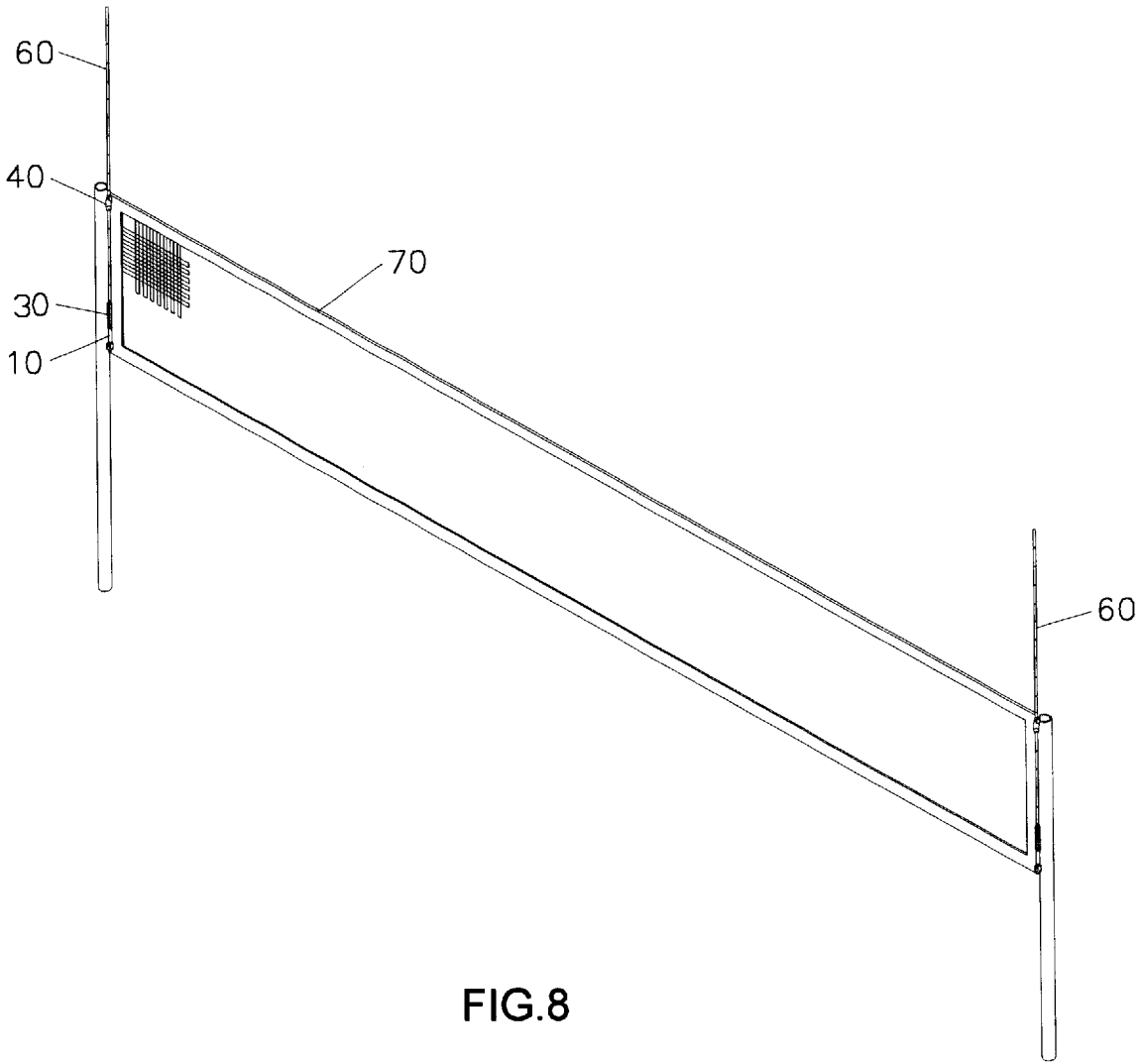
FIG. 8 is a schematic plan view showing the vertical aerial assembly for a volleyball net assembly being mounted on the net.

Referring to FIG. 8, the vertical aerial assembly for a volleyball net assembly is mounted on each of the two opposite sides of the net 70.

Figure 9:
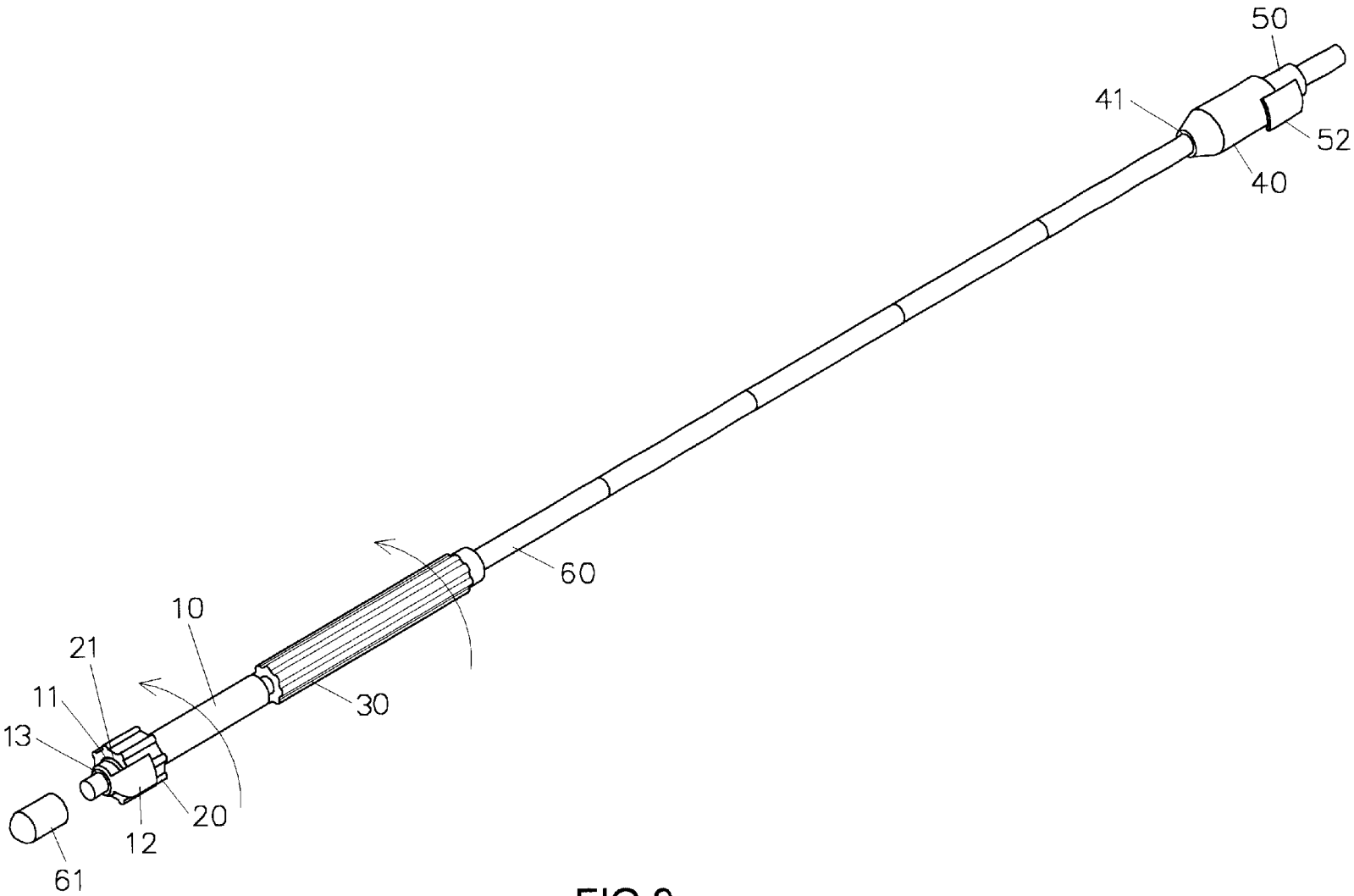
FIG. 9 is a perspective assembly view of the vertical aerial assembly for a volleyball net assembly in accordance with the second embodiment of the present invention.

Referring to FIG. 9, the vertical aerial assembly for a volleyball net assembly in accordance with the second embodiment of the present invention further comprises an indicator 61 mounted on the bottom of the lower fixing rod 10 or the aerial 60. Thus, the light emitted from the indicator 61 may be used to register and align the border of the volleyball court.

Accordingly, the vertical aerial assembly for a volleyball net assembly in accordance with the present invention has the following advantages.

1. The vertical aerial assembly has a simplified construction with fewer parts, thereby decreasing the cost of fabrication.

2. The vertical aerial assembly is assembled easily and conveniently, thereby saving the time of assembly.

3. The handle 30 only needs to form a through hole 31 to fit the outer diameter of the aerial 60 without having to additionally provide a stepped hole, thereby decreasing the cost of fabrication.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A vertical aerial assembly for a volleyball net assembly, comprising a lower fixing rod, a lower screw member, an aerial, a handle, an upper screw member, and an upper fixing rod, wherein:

the lower fixing rod has a first end formed with an outer threaded portion and provided with a lower fixing hook;

the lower screw member is mounted on the lower fixing rod, and has an inner wall formed with an inner threaded portion screwed on the outer threaded portion of the lower fixing rod;

the aerial has one secured in the lower fixing rod;

the handle is secured on the aerial, and has one end rested on a second end of the lower fixing rod;

the upper screw member is secured on the aerial, and has an inner wall formed with an inner threaded portion; and the upper fixing rod is mounted on the aerial, and has a first end formed with an outer threaded portion screwed into the inner threaded portion of the upper screw member, and a second end provided with an upper fixing hook.

2. The vertical aerial assembly for a volleyball net assembly in accordance with claim 1, wherein the lower fixing rod has an inner wall formed with a through hole for passage of the aerial.

3. The vertical aerial assembly for a volleyball net assembly in accordance with claim 1, wherein the aerial is an elongated rod.

4. The vertical aerial assembly for a volleyball net assembly in accordance with claim 1, wherein the handle has an inner wall formed with a through hole for passage of the aerial.

5. The vertical aerial assembly for a volleyball net assembly in accordance with claim 1, wherein the upper fixing rod has an inner wall formed with a through hole for passage of the aerial.

6. The vertical aerial assembly for a volleyball net assembly in accordance with claim 1, further comprising an indicator mounted on the bottom of the lower fixing rod.

7. The vertical aerial assembly for a volleyball net assembly in accordance with claim 1, further comprising an indicator mounted on the bottom of he aerial.

* * * * *